US011490666B2

(12) United States Patent
Monier et al.

(10) Patent No.: US 11,490,666 B2
(45) Date of Patent: Nov. 8, 2022

(54) DISPOSABLE INDIVIDUAL COVERING WORKSUIT FOR PROTECTION AGAINST RADIOACTIVE PARTICLES

(71) Applicant: Electricite de France, Paris (FR)

(72) Inventors: Catherine Monier, Paris (FR); Gilles Rougon, Veneux-les-Sablons (FR); Victor Spazzola, Saint André de la Marche (FR)

(73) Assignee: Electricite de France

( * ) Notice: Subject to any disclaimer, the term of this patent is extended or adjusted under 35 U.S.C. 154(b) by 0 days.

(21) Appl. No.: 17/297,837

(22) PCT Filed: Nov. 29, 2019

(86) PCT No.: PCT/FR2019/052847
§ 371 (c)(1),
(2) Date: May 27, 2021

(87) PCT Pub. No.: WO2020/109742
PCT Pub. Date: Jun. 4, 2020

(65) Prior Publication Data

US 2022/0000193 A1 Jan. 6, 2022

(30) Foreign Application Priority Data

Nov. 30, 2018 (FR) ..... 18 72160

(51) Int. Cl.
*A41D 13/02* (2006.01)
*G21F 3/025* (2006.01)

(52) U.S. Cl.
CPC ..... *A41D 13/02* (2013.01); *G21F 3/025* (2013.01); *A41D 2300/322* (2013.01)

(58) Field of Classification Search
CPC .. A41D 13/02; A41D 15/00; A41D 2300/322; A41B 13/005; G21F 3/025
See application file for complete search history.

(56) References Cited

U.S. PATENT DOCUMENTS 1,973,421 A * 9/1934 Wallace ..... A41B 13/005 2/80
2,622,248 A * 12/1952 Schaye ..... A44B 19/24 2/80

(Continued)

FOREIGN PATENT DOCUMENTS

DE 29803290 U1 4/1998
EP 2716184 A1 * 4/2014 ..... A41D 13/129

(Continued)

OTHER PUBLICATIONS

International Search Report for Application No. PCT/FR2019/052847, dated Feb. 24, 2020, 2 pages.

*Primary Examiner* — F Griffin Hall
(74) *Attorney, Agent, or Firm* — Lerner, David, Littenberg, Krumholz & Mentlik, LLP

(57) ABSTRACT

The invention concerns a disposable individual overall (1) for protection against radioactive particles, comprising a zip closure (FG1) from top to bottom and on the front in the trunk portion (3). The invention is characterized in that at least one other closure (FG2) extends from top to bottom in at least one of the legs (31, 32) of the trouser part (3) and comprises two strips (BA31, BA32) capable of being connected along another prescribed meshing line (LE3), at least one junction point (S) connecting two of the strips (BA31, BA32) beyond the other line (LE3) being present between the closure (FG1) and the other closure (FG3) in the closed state, a breaking member (CU) being provided on at least one of the closures (FG1, FG3) in order to allow breaking of the junction point (S) by pulling on the breaking member (CU).

36 Claims, 15 Drawing Sheets

(56) References Cited

Figure 1:
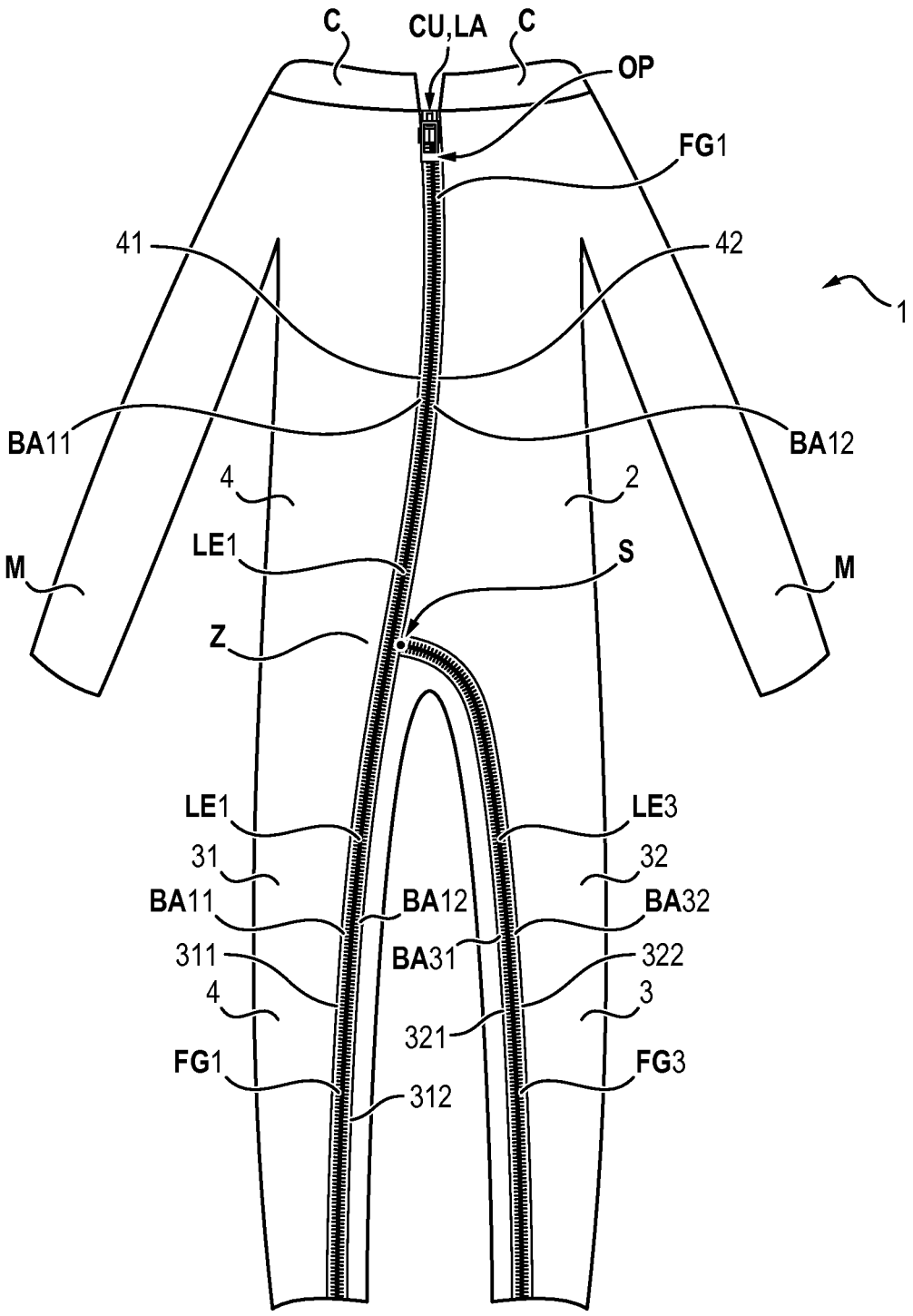

U.S. PATENT DOCUMENTS 4,117,609 A * 10/1978 Helt ..... A41D 13/012 2/227
4,158,892 A * 6/1979 Gonzales ..... A41D 10/00 2/69.5
4,677,696 A * 7/1987 Tanaka ..... A41D 13/02 2/456
4,935,975 A * 6/1990 Mahar ..... A41D 13/1263 5/81.1 T
5,369,809 A * 12/1994 Hall ..... A41D 27/18 2/202
5,784,717 A * 7/1998 Singer ..... A41D 13/02 2/79
7,310,825 B2 * 12/2007 St-Germain ..... A41D 27/10 2/123
8,701,214 B2 * 4/2014 Stoneham ..... A41B 13/005 2/79
9,119,428 B2 * 9/2015 Kuelker ..... A41D 13/02
10,522,058 B2 * 12/2019 Passman ..... A41D 1/00
2007/0277278 A1 * 12/2007 O'Brien ..... B63C 11/04 2/2.17
2009/0222968 A1 * 9/2009 Pisano-Ginter ..... A41B 13/005 2/80
2009/0293169 A1 * 12/2009 Wise ..... A41B 13/005 2/80
2010/0050485 A1 * 3/2010 Forte ..... G09F 21/02 40/1.5
2012/0042433 A1 2/2012 Damon et al.
2013/0326786 A1 * 12/2013 Wong ..... A41D 1/22 2/79
2015/0128333 A1 * 5/2015 Atallah ..... A62B 17/001 2/455

FOREIGN PATENT DOCUMENTS

ES 1035646 U 5/1997
FR 2281072 A1 3/1976
FR 2594009 A1 * 8/1987 ..... A41D 13/02
JP 06049701 A * 2/1994 ..... A41D 13/02
KR 20120018626 A 3/2012

* cited by examiner

DISPOSABLE INDIVIDUAL COVERING WORKSUIT FOR PROTECTION AGAINST RADIOACTIVE PARTICLES

CROSS-REFERENCE TO RELATED APPLICATIONS

The present application is a national phase entry under 35 U.S.C. § 371 of International Application No. PCT/FR2019/052847 filed Nov. 29, 2019, which claims priority from French Application No. 1872160 filed Nov. 30, 2018, all of which are incorporated herein by reference.

The invention concerns a disposable individual covering worksuit for protection against radioactive particles.

The invention is applied in industrial activity in a contaminated environment. Contaminated means an environment in which radioactive particles are dispersed that are likely to come into contact with the operator staff in the facilities.

In the following, the disposable individual covering worksuit for protection against radioactive particles is also called covering worksuit.

In nuclear power plants, inspections and maintenance of various equipment are scheduled. In some areas, operators are subjected to ionizing radiation. These work areas are called controlled areas. They are classified according to the nature of their hazardousness and conform with very strict rules in order to protect the operator working therein. One of these risks is contamination. It is a question of a radioactive material that can potentially spread in the air and on the ground of a room if a circuit is opened. Every precaution is taken so that the operator cannot ingest or inhale these radioactive particles. Depending on the activity per unit of area measured (contamination rate indicator) in each room, the operator must follow rules for donning and removing clothing. For certain procedures in a so-called controlled area, the operator must cover with a nonwoven paper coverall (the covering worksuit), such as those from the manufacturer Tyvek, on top of their work clothes.

Despite these covering worksuits, operators have been observed to contaminate themselves in some phases of work. Some of these contaminations originate from the characteristics of the covering worksuit used.

Covering worksuits currently used in a fleet of nuclear power plants in operation of the fleet are universally used for all jobs and environments. These mainly ensure a seal against contamination during activities in contaminated areas. However, these covering worksuits can prove insufficient during the undressing phase, for example.

Generally, when the operator has to perform a procedure in a contaminated room or a controlled area, they first cover their usual clothing, called underlying layer (which can be in a first case their personal clothing, so-called "work blues", or in a second case, a so-called required universal clothing, such as, for example, a T-shirt, a pair of socks, an overall, a pair of cotton gloves, a cap and a helmet), with the covering worksuit, as well as gloves of vinyl or of a thicker material such as rubber or another plasticized material and boot covers.

The covering worksuit must be worn when the radioactive activity per unit of area is comprised between 0.4 and 400 $Bq/cm^2$ in the first case and between 4 and 400 $Bq/cm^2$ in the second case. Above 400 $Bq/cm^2$, the operator must wear a ventilated helmet, for example a protection covering the entire head to the base of the neck, or even a sealed ventilated suit over their covering worksuit, for example, a protection covering the entire body.

To leave a controlled area, various checks are planned to detect any contamination. However, vigilance at all times is essential in the critical undressing phase. It is all the more important for nuclear power plants, given that said personal clothing of the operators are likely to be worn and washed in the private sphere, unlike universal clothing that does not leave the nuclear power plant.

The undressing phase related to the covering worksuit is tricky. For example, in nuclear power plants in France, when in a contaminated area, operators must remove the covering worksuit, gloves and boot covers without contaminating their own clothing—generally "work blues" worn underneath—and operators must then cross a boundary, for example marked by a sawhorse, to pass into a non-contaminated area.

Although it has proven itself in radiation protection, this boundary crossing is not always easy for the operator and can lead to disadvantages. Indeed, the operator must put a first leg with the covering worksuit removed behind the sawhorse without touching it and keep the second leg still clothed in the covering worksuit in the contaminated area. Then they must remove the second leg from the covering worksuit in the contaminated area, then cross the boundary to finally reach the uncontaminated area. These crossing conditions can lead to losses of balance and resting the foot of the uncovered leg in the contaminated area. Once the boundary is finally successfully crossed, the operator, who might have been contaminated, goes through control portals as is required in all nuclear power plants in the world, which will signal any actual contamination. The operator then follows the current protocol after detection of contamination, regardless of origin. The risk of so-called accidents on the same level can also be mentioned incidentally.

This protection practice of wearing a covering worksuit is a tool for combatting operator contamination but does not solve certain problems that have been identified with covering worksuits bought on the market. The main disadvantages are presented below.

A first disadvantage is the risk of contamination in the case of non-standard undressing. In order to overcome constraints related to crossing area boundaries, the operator may find advantageous to first remove their covering worksuit in the contaminated area and then cross the boundary. To do so, they must first open the zip closure from the collar to the crotch, then tear their covering worksuit from the crotch to the bottom of each leg, which will provide ease in the shoulders and prevent them from being in an off-balance position. This practice, not recommended by the plant operator, certainly saves time, but the main disadvantage is that the potential contamination deposited on the covering worksuit during the work can then be suspended in the air following the force of tearing and therefore lead to the contamination of the operator, their coworkers and the premises.

A second disadvantage is the risk of contamination by opening the covering worksuit. When working in a controlled area, operators are required to carry documents and portable devices such as, for example, a dosimeter that must be visually accessible according to the regulations. In this case, the operator may have to open the covering worksuit to access the information sought in said documents or displayed by said devices. In doing so, the operator runs a potential risk of direct contamination by their gloves. To resolve this disadvantage, current non-woven covering worksuits comprise at least one transparent plastic window designed to display the underlying clothing in line with the locations of said control devices, badges or documents worn on it. However, said plastic windows can lose transparency quickly, even during a single operation, due to friction, folds, etc. Under these conditions, the information sought by the operator becomes increasingly less clear or visible, so that to access it, the operator must open their covering worksuit, which is in contradiction with the goal of limiting contamination risk.

The invention relates to obtaining an individual disposable covering worksuit for protection against radioactive particles that alleviates the disadvantages of covering worksuits mentioned above.

To this end, the invention first relates to a disposable and individual covering worksuit for protection against radioactive particles, comprising a trunk part and a trouser part, which is of one piece with the trunk part and which extends down from the trunk part, the trunk part and the trouser part having a flexible and dustproof wall, the covering worksuit comprising a first zip closure, which extends from top to bottom and on the front between two first left and right edges of the wall at least in the trunk part, the first zip closure having a first side attached in a dustproof manner to the left edge of the wall and a second side attached in a dustproof manner to the right edge of the wall, the first and second sides being able to be connected together according to a first prescribed and dustproof meshing line in the closed state of the first zip closure and being able to be separated from each other along the first meshing line in the open state of the first zip closure (FG1), characterized in that the covering worksuit (1) comprises at least one other closure, which extends from top to bottom between two other opposite edges of the wall in at least one of the legs of the trouser part and which comprises two strips respectively attached in a dustproof manner to the two other opposite edges of the wall, the two strips being able to be connected to each other according to at least one other prescribed and dustproof meshing line in the closed state of the other closure and being able to be separated from each other along the other meshing line in the open state of the other closure, at least one connection point connecting together at least two of the strips beyond the other meshing line being present between the first zip closure (FG1) and the other closure in the closed state of the closures, at least one breaking member being provided on at least one of the closures to be able to break the connection point by pulling on the breaking member.

According to one embodiment of the invention, the first zip closure further extends from top to bottom between two opposite edges of the wall in the other of the legs of the trouser part.

According to one embodiment of the invention, the connection point is located on the first or second side of the first zip closure, the first zip closure comprising a slider making it possible to connect the first and second sides together along the first meshing line by raising the slider along them and making it possible to separate the first and second sides from each other along the first meshing line by lowering the slider along one of the first and second sides, the breaking member being formed by the slider, whose descent along the connection point makes it possible to break the connection point.

According to another embodiment of the invention, the following is provided as other closure:

at least one second closure, which extends from top to bottom between two second opposite edges of the wall in one of the legs of the trouser part and which comprises two second strips respectively attached in a dustproof manner to the two second opposite edges of the wall, the two second strips being able to be connected to each other according to a second prescribed meshing line, dustproof in the closed state of the second closure, and being able to be separated from one another along the second meshing line in the open state of the second closure, and at least one third closure, which extends from top to bottom between two third opposite edges of the wall in the other of the legs of the trouser part and which comprises two third strips respectively attached in a dustproof manner to the two third opposite edges of the wall, the two third strips being able to be connected to each other according to a third prescribed meshing line, dustproof in the closed state of the third closure, and being able to be separated from one another along the third meshing line in the open state of the third closure.

According to one embodiment of the invention, the following are provided as connection point:

a first connection point that connects together the upper ends of the two second strips of the second closure, and a second connection point that connects together the upper ends of the two third strips of the third closure, and the breaking member comprising a tab attached to the second strip and to the third strip close to each other and close to the first and second connection points, to allow breaking the first and second connection points by pulling on the tab, separating the two second strips from each other along the second meshing line and separating the two third strips from each other along the third meshing line.

According to one embodiment of the invention, the connection point is formed by a connection part, which, in the closed state of the closures, comprises a first connection flank connecting together the lower ends of the first and second sides of the first zip closure, a second connection flank connecting together the upper ends of the two second strips of the second closure and a third connection flank connecting together the upper ends of the two third strips of the third closure, the first zip closure comprising a slider making it possible to connect the first and second sides together along the first meshing line by raising the slider along them and making it possible to separate the first and second sides from each other along the first meshing line by lowering the slider along one of the first and second sides, the breaking member being formed by the slider whose descent along the connection part makes it possible to break the first, second and third connection flanks.

According to one embodiment of the invention, the at least one other closure is a zip closure, comprising another slider allowing it to connect the two strips together along the other meshing line by movement of the other slider from bottom to top along these strips and allowing the two strips to be separated from each other along the other meshing line by movement of the other slider from top to bottom along one of the strips.

According to another embodiment of the invention, the two strips of the at least one other closure mesh with one another along the other meshing line in the closed state of the at least one other closure, the two strips of the at least one other closure being able to be separated from each other along the other meshing line by pulling on one and/or the other of the two strips.

According to one embodiment of the invention, the connection point is located in the crotch or lower abdomen area of the trouser part.

According to another embodiment of the invention, the trunk part ends at the top with a dustproof collar, having two left and right front parts connected together by a dustproof front closure strip located beyond the upper end of the first zip closure.

According to another embodiment of the invention, two free front and side tags are attached in front of the front closure strip.

According to another embodiment of the invention, the covering worksuit comprises stitching lines visible on its wrong side and invisible on its right side.

According to another embodiment of the invention, the covering worksuit comprises sleeves to pass the arms therethrough, wherein the sleeves comprise a dustproof second wall, are connected at the top of the trunk part, a free end edge of the sleeves surrounds an end opening allowing the passage of at least the index finger, middle finger, ring finger and little finger of the hand, the sleeves further comprise at least one hole for passing the thumb, distinct from the opening and separated from the end edge by an end part of the second wall.

According to another embodiment of the invention, the covering worksuit comprises a tightening elastic situated in a sheath in the waist.

According to another embodiment of the invention, the covering worksuit comprises reinforcements at knees of the trouser part.

According to another embodiment of the invention, the covering worksuit comprises at least one transparent outer wall, which is located to the right and/or the left of the first closure on the front in the trunk part and which forms at least one pocket with at least one other underlying wall. According to another embodiment of the invention, the covering worksuit comprises a removable stomach pouch having a transparent outer wall, the removable stomach pouch having an upper part comprising a fourth zip closure and fasteners that can be connected and disconnected relative to a front upper part of the trunk part.

Figure 2:
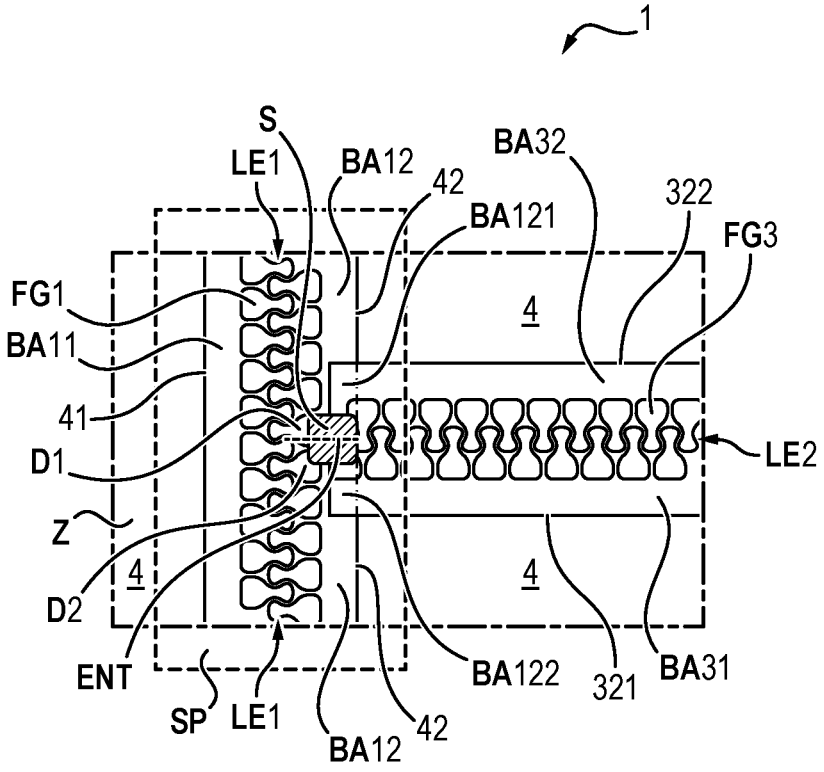
Figure 3:
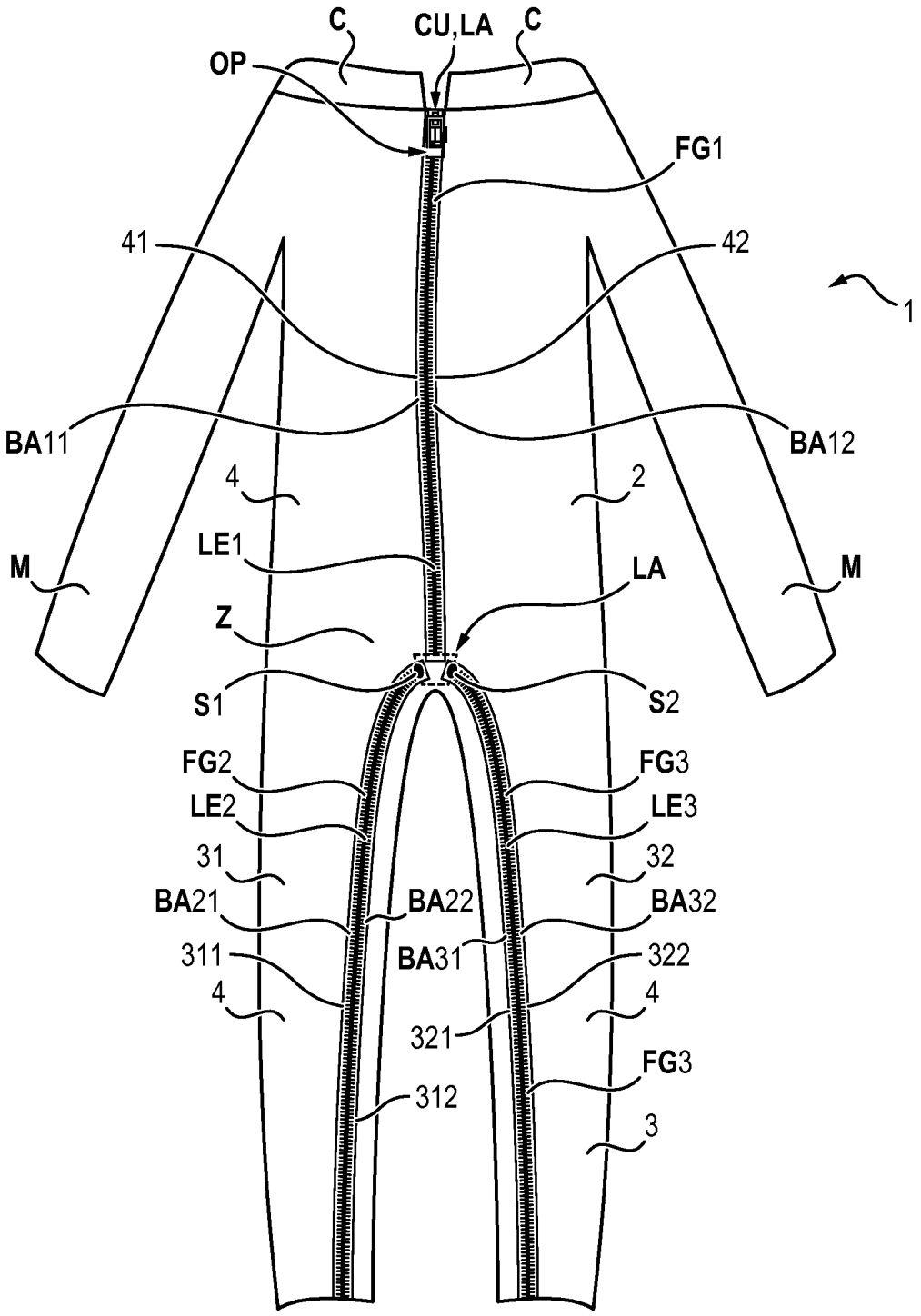
Figure 4:
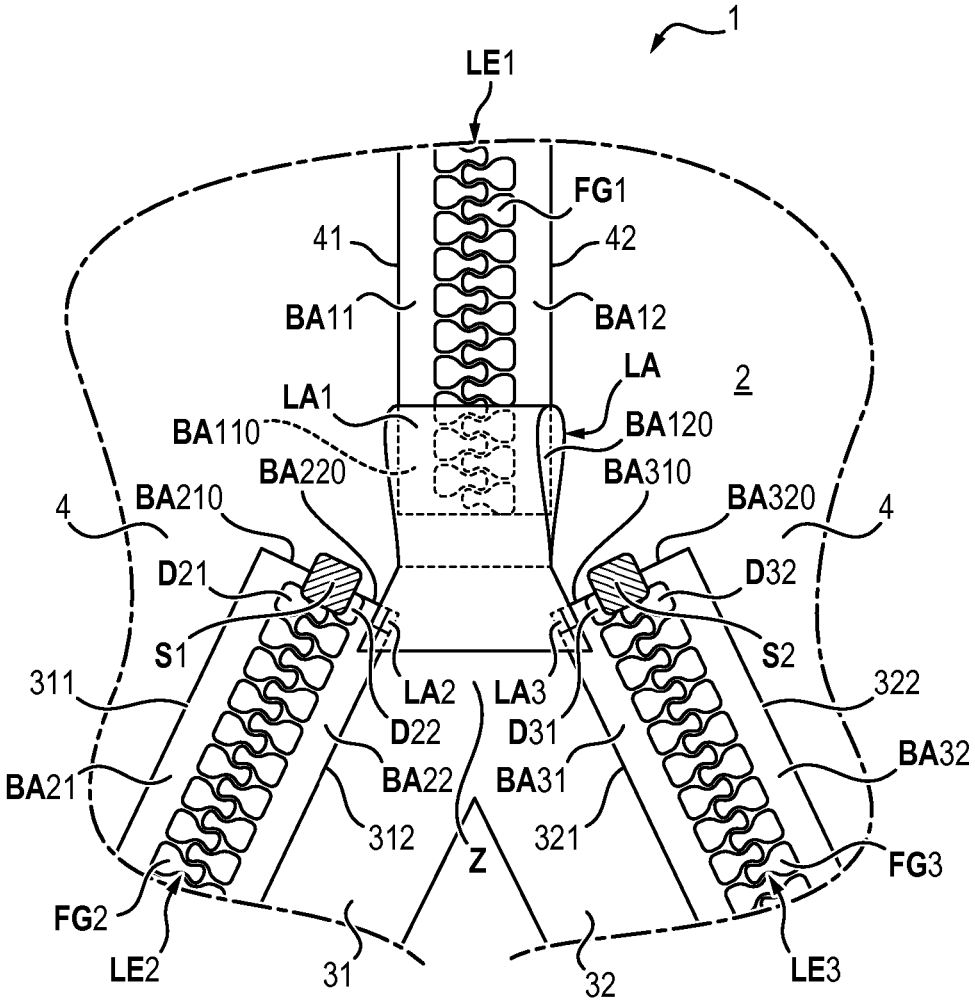
Figure 5:
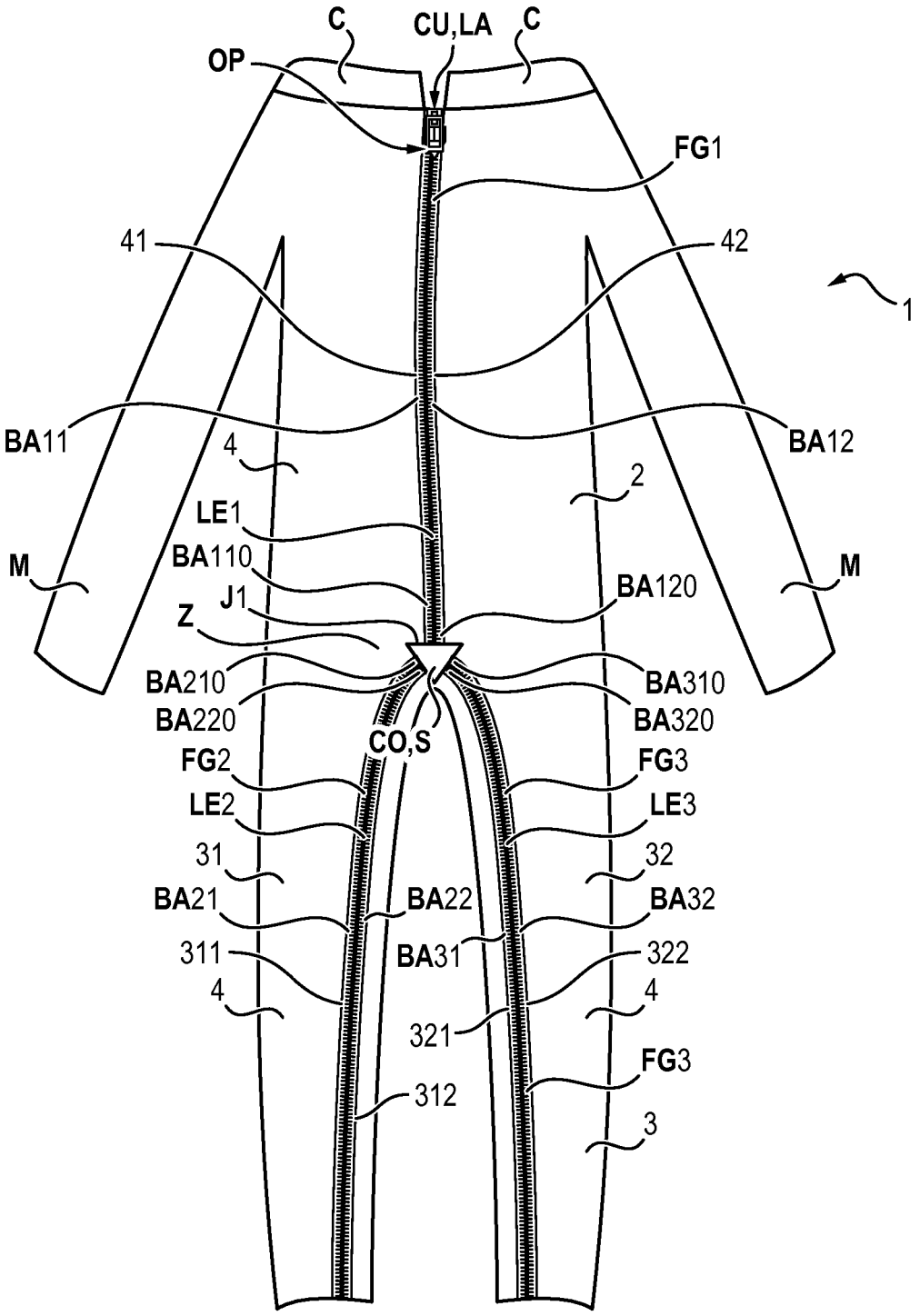
Figure 6:
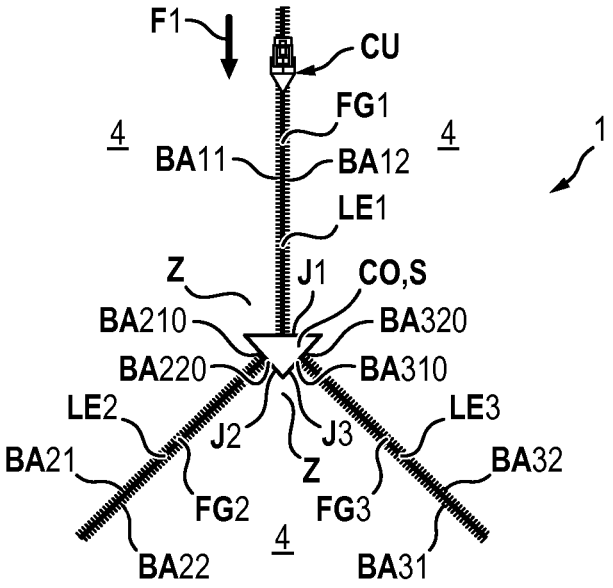
Figure 7:
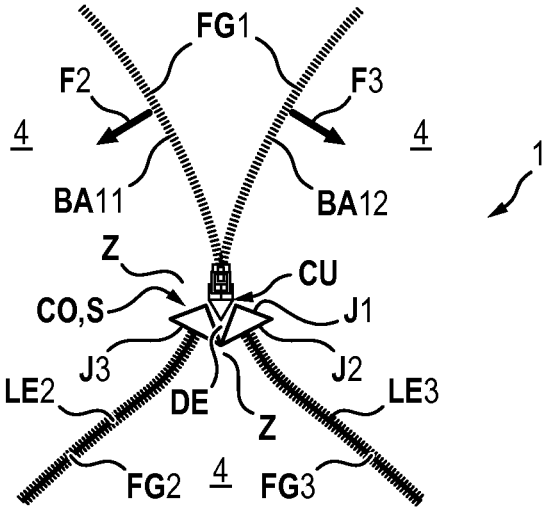
Figure 8:
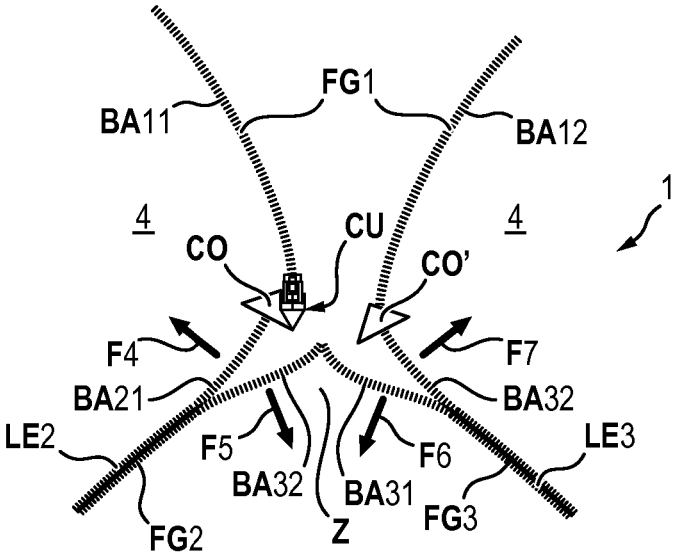
Figure 9:
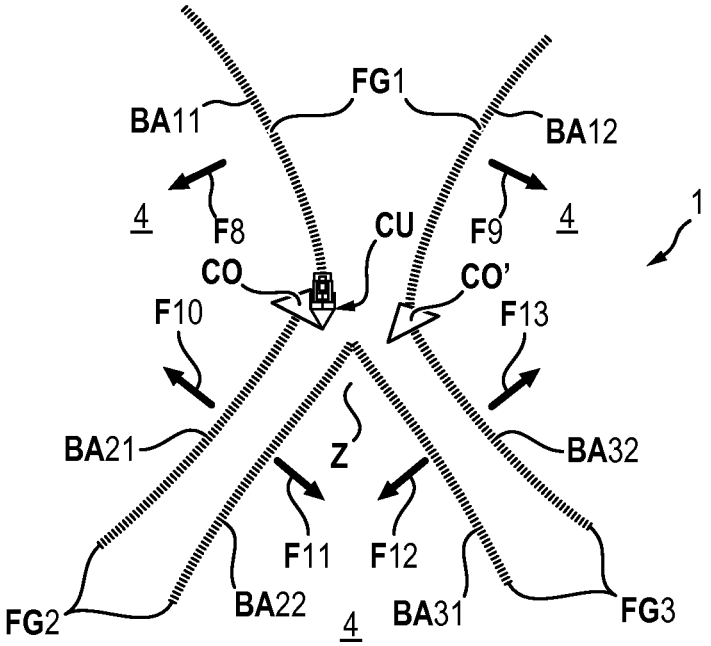
Figure 10:
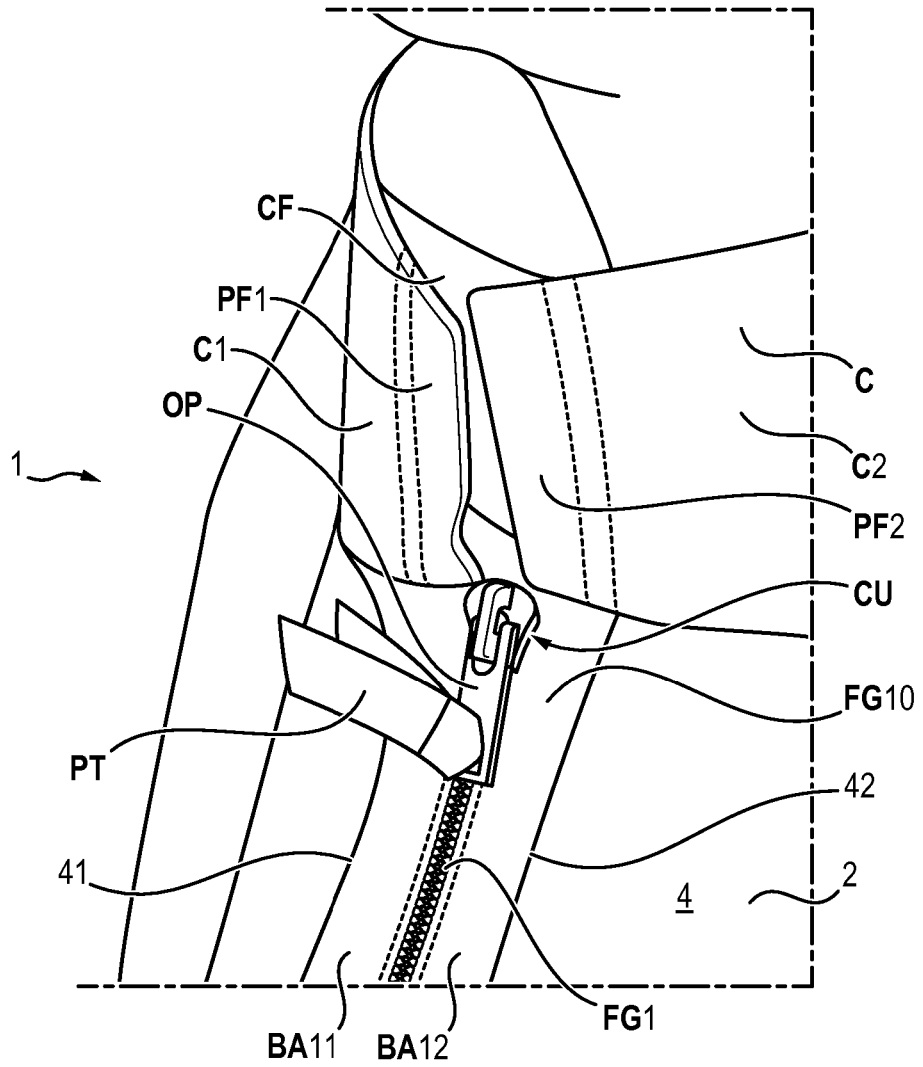
Figure 11:
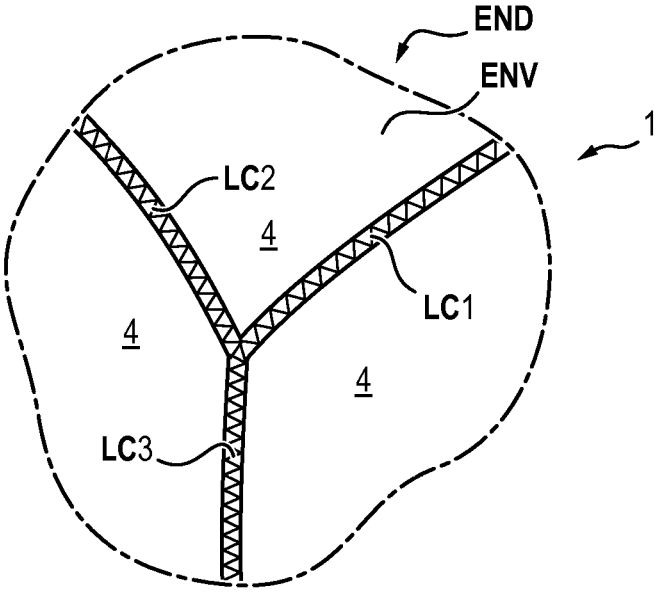
Figure 12:
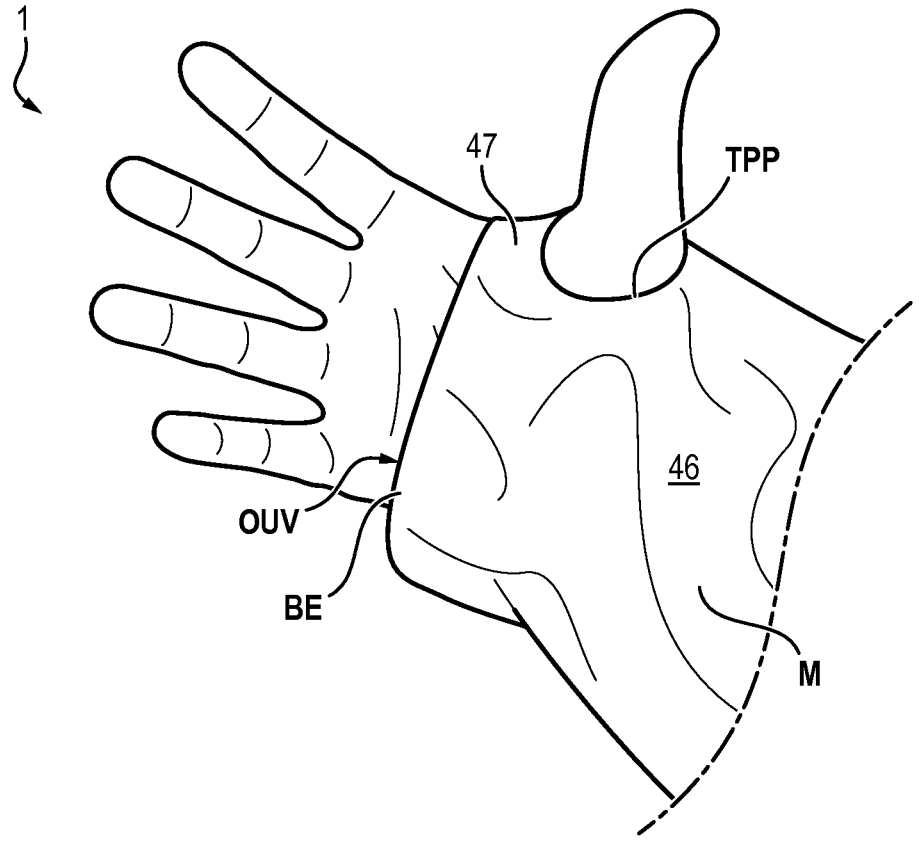
Figure 13:
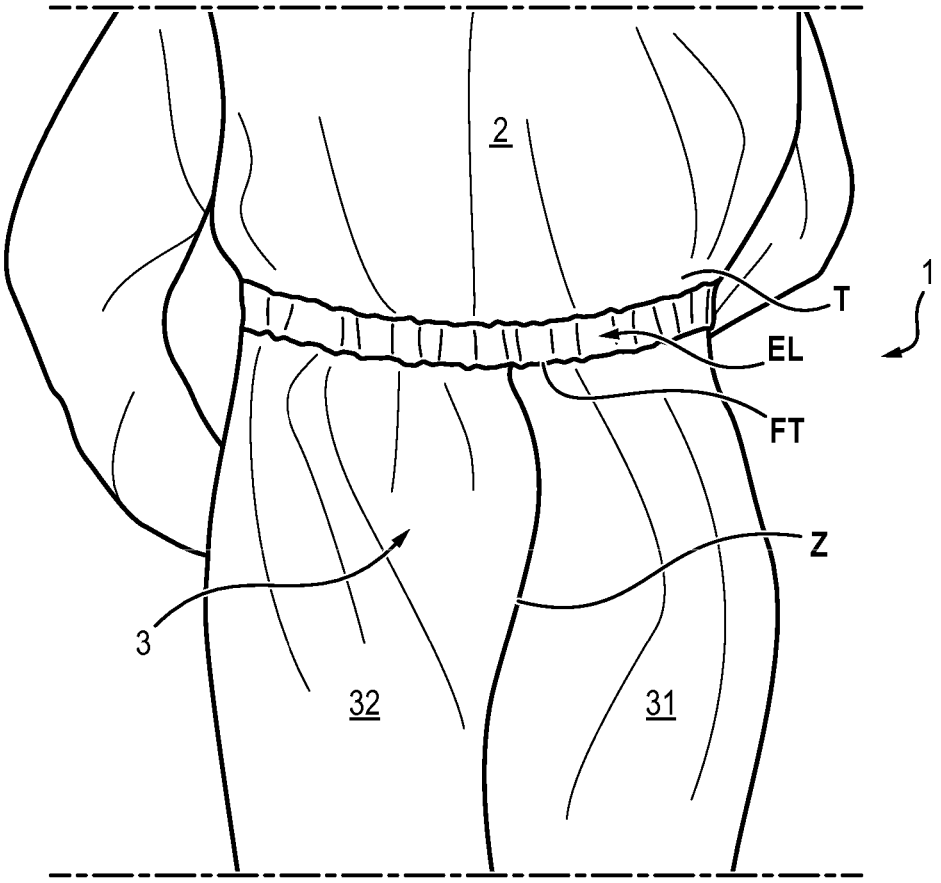
Figure 14:
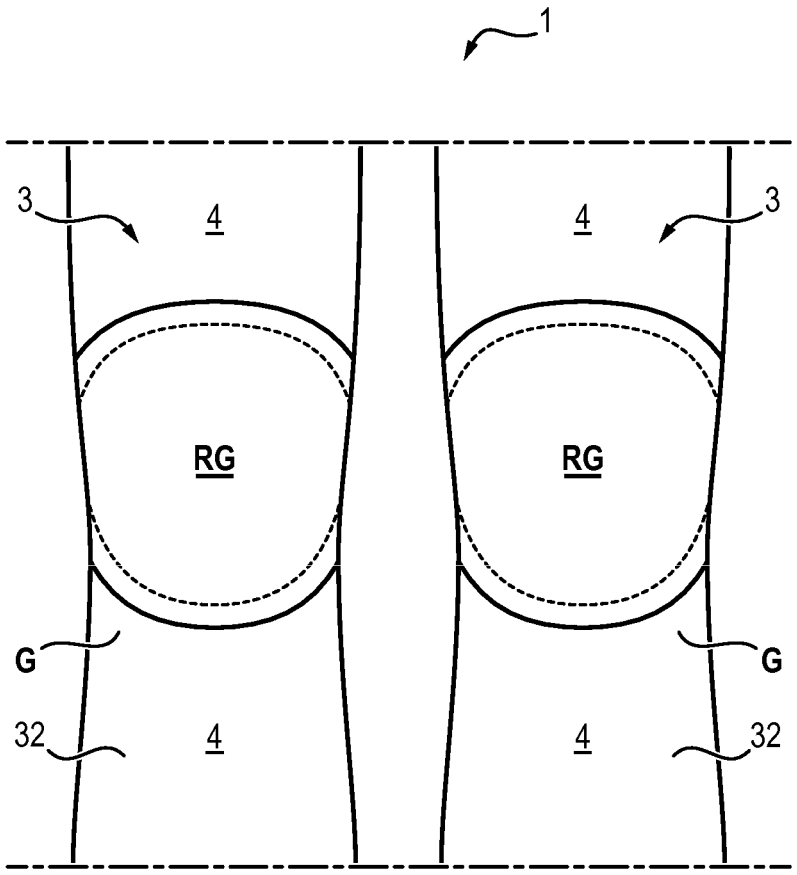
Figure 15:
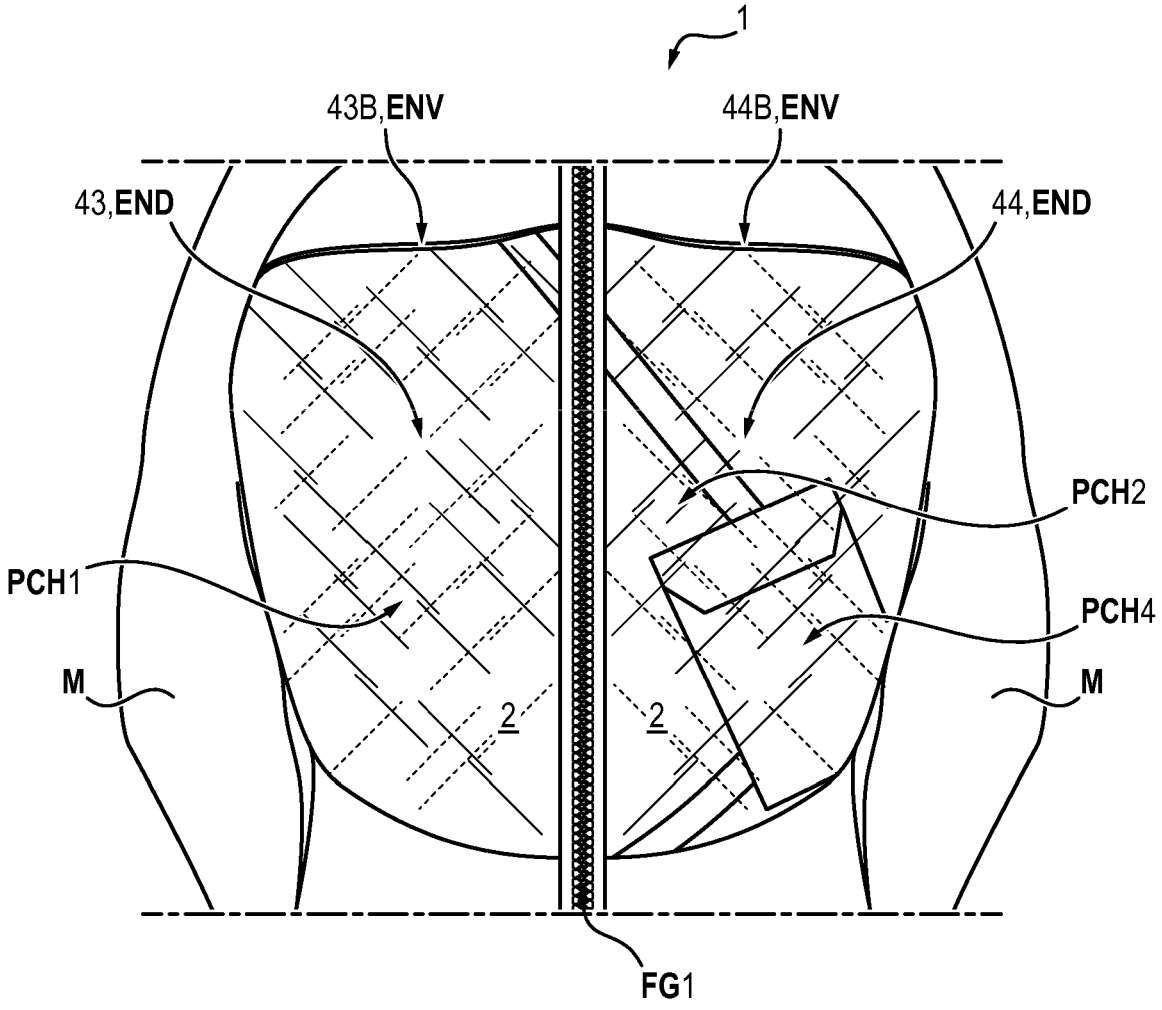
Figure 16:
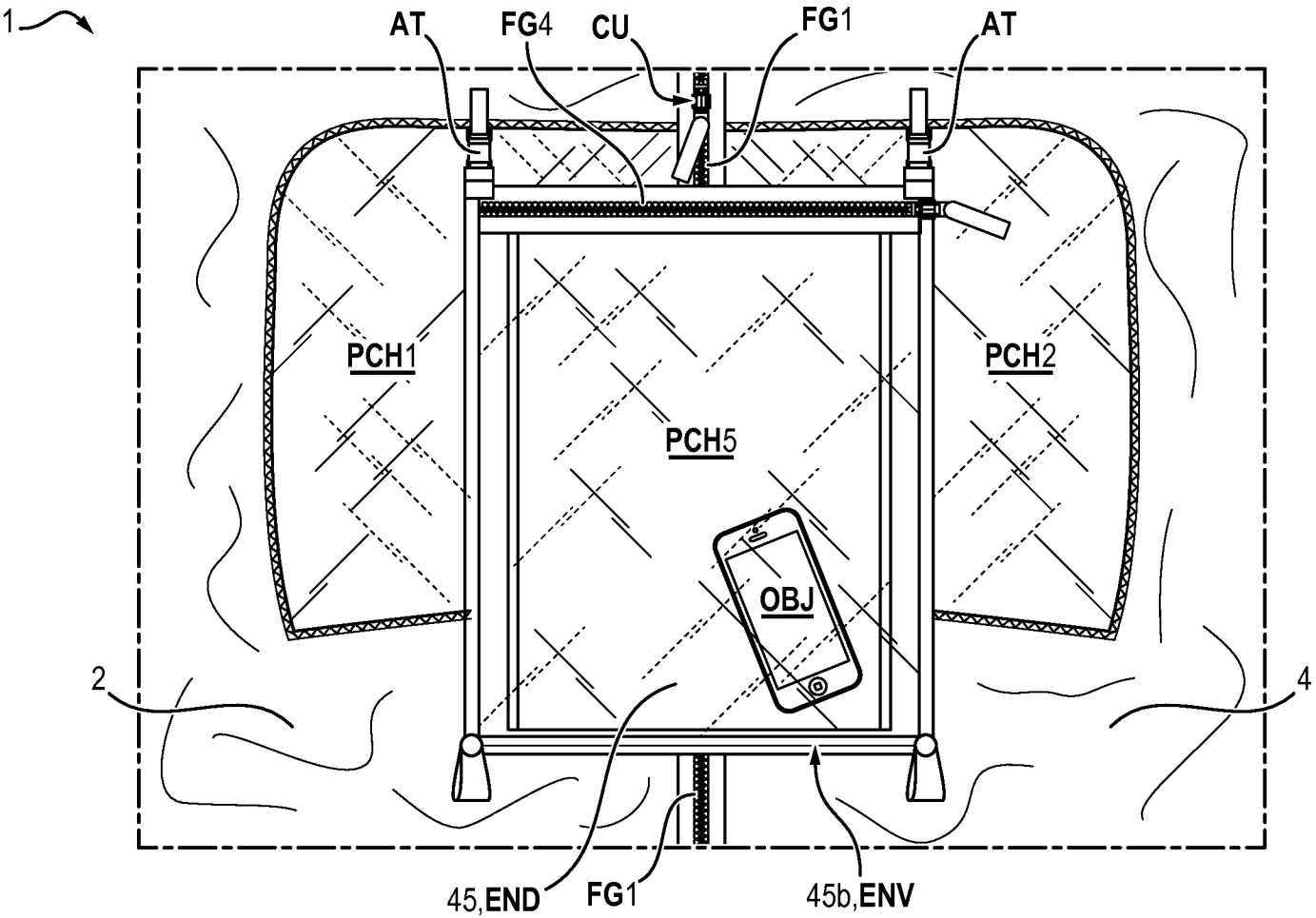
Figure 17:
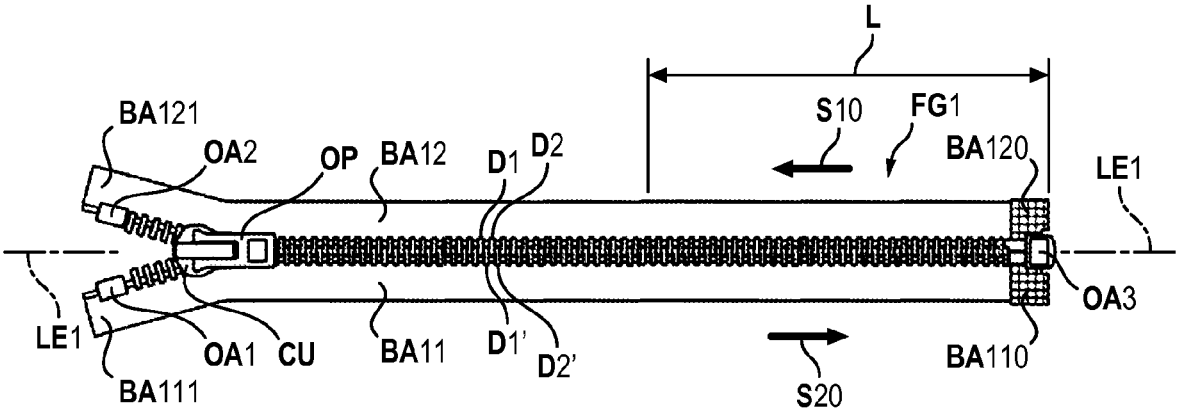

The invention will be better understood upon reading the description that will follow, given solely by way of non-limiting example in reference to the attached figures of drawings, in which:

FIG. 1 is a schematic front view of a protective covering worksuit according to a first embodiment of the invention, right side out, FIG. 2 is a larger scale schematic front view of a crotch area of the covering worksuit according to FIG. 1, FIG. 3 is a schematic front view of a protective covering worksuit according to a second embodiment of the invention, right side out, FIG. 4 is a schematic front view of the crotch area of the covering worksuit according to FIG. 3, wrong side out, FIG. 5 is a schematic front view of a protective covering worksuit according to a third embodiment of the invention, right side out, FIG. 6 is a schematic front view of a crotch area of the covering worksuit according to FIG. 5 during a first step of opening the covering worksuit, right side out, FIG. 7 is a schematic front view of a crotch area of the covering worksuit according to FIG. 5 during a second step of opening the covering worksuit, right side out, FIG. 8 is a schematic front view of a crotch area of the covering worksuit according to FIG. 5 during a third step of opening the covering worksuit, right side out, FIG. 9 is a schematic front view of a crotch area of the covering worksuit according to FIG. 5 during a fourth step of opening the covering worksuit, right side out, FIG. 10 is a schematic perspective front view of another embodiment of the invention, right side out, FIG. 11 is a schematic front view of a part of the covering worksuit according to another embodiment of the invention, wrong side out, FIG. 12 is a schematic front view of a part of the covering worksuit according to another embodiment of the invention, FIG. 13 is a schematic back view of a part of the covering worksuit according to another embodiment of the invention, right side out, FIG. 14 is a schematic front view of a part of the covering worksuit according to another embodiment of the invention, right side out, FIG. 15 is a schematic front view of a part of the covering worksuit according to another embodiment of the invention, right side out, FIG. 16 is a schematic front view of a part of the covering worksuit according to another embodiment of the invention, right side out, FIG. 17 is a schematic front view of a zip closure that can be used in the covering worksuit according to the invention, right side out.

In the figures, different embodiments of the individual disposable covering worksuit 1 for protection against radioactive particles or of the covering worksuit 1 are shown. Covering worksuit 1 mainly comprises a trunk part 2 joined on the bottom to a trouser part 3 extending from it. Right and left sleeves M for the user's arms are provided in the upper part of trunk 2. A collar C is found in the upper part of trunk 2, that can be extended in the back by a hood, not shown. Trunk part 2, trouser part 3 and sleeves M comprise one or more flexible dustproof walls 4, which are configured to prevent radioactive particles from passing through the covering worksuit from the outside to the inside. Generally, the seal indicated for the various parts of covering worksuit 1, especially for wall 4, is a dustproof seal and may also be waterproof from the outside to the inside and/or water vapor proof from the outside to the inside. Moreover, one or more parts of covering worksuit 1, especially wall 4, can be breathable, i.e., allow water vapor to pass from the inside to the outside. Wall 4 may, for example, be continuous from trunk part 2 to trouser part 3. This flexible wall 4 can be nonwoven, for example, of a paper, as is known.

Covering worksuit 1 and/or wall 4 can, for example, have any one or all of the following properties (the standards indicated are those in effect on 22 Dec. 2015):

- Mass per unit area according to standard NF EN ISO 3801 comprised between 40 and 70 g/m$^2$.
- Abrasion resistance according to standard NF EN 13034, standard NF EN 1073-2 (test according to standard NF EN 530) and standard NF EN ISO 13982-1: Class 2/6 (>100 abrasive cycles).
- Resistance to cracking by flexing according to standard NF EN ISO 13982-1 (test according to method B of NF EN ISO 7854): Class 6/6 (>100,000 cycles).
- Puncture resistance according to standard NF EN ISO 1073-2 (test according to standard EN 863): Class 2/4 (>10 N).
- Puncture resistance according to standard NF EN 13034 and standard NF EN ISO 13982-1 (test according to standard EN 863): Class 2/6 (>10 N).

Trapezoid tearing resistance according to standard NF EN 13034 and standard NF EN ISO 13982-1 (test method: standard EN ISO 9073-4): Class 2/6 (>20 N).

Tearing resistance according to standard NF EN 1073-2 (test method according to standard EN ISO 9073-4): Class 3/6 (>20 N).

Resistance of seams, joints and assemblies according to standard NF EN 13034 and standard NF EN ISO 13982-1 (test method according to standard EN ISO 13935-2): Class 3/6 (>75 N).

Resistance of seams according to standard NF EN 1073 (test method according to standard EN ISO 13935-2): Class 3/5 (>75 N).

Tensile strength according to standard NF EN ISO 13034 (test method according to standard EN ISO 13934-1: or standard EN 29073-3): Class 2/6 (>60 N).

Property against the penetration of liquid chemical products: Compliance with Type 6 classification according to standard NF EN 13034. The specifications for covering worksuit 1 for protection against liquid radioactive contamination by contact (light and not extended) or by light splashes are assimilated to those of type 6 clothing. Consequently, the requirements of standard NF EN 13034 (type 6) and the associated test methods apply to this product. However, it remains comfortable to wear. Liquid repellency: Class 3/3 (Repellency index>95% at least for standardized products such as $H_2SO_4$, NaOH, o-xylene and butane-1-ol). Protection from chemical product penetration: Class 3/3 (Penetration index <1% at least for standardized products such as $H_2SO_4$, NaOH, o-xylene and butane-1-ol). Protection against penetration of liquids in the form of a light spray (mist test): compliance with the requirements of standard NF EN 13034.

Particle penetration property: The clothing complies with Type 5 classification according to standard NF EN ISO 13982-1 and complies with standard NF EN 1073-2. Inward leaking according to standard NF EN ISO 13982-1 (test according to standard NF EN ISO 13982-2): compliance with the minimum requirement i.e. $IL_{82/90} \leq 30\%$ and $TILS_{8/10} \leq 15\%$. Total inward leaking according to NF EN 1073-2 (test according to standard NF EN ISO 13982-2): Class 1/3.

Anti-electrostatic property: The surface resistivity is evaluated according to the test method described in standard NF EN 1149-1. The homogenous material must have a surface resistivity less than or equal to $5 \times 10^{10}$ ohms.

Protection against flame: The constituent material (including any hood and translucent windows) must be classified level 1 according to standard NF EN ISO 14116, insofar as this equipment is intended to be worn over base clothing having a higher level of protection.

The product is free of toxic chemicals (Pb, B, Ni, Cr, As, Sb, Se, Cd, Hg, Be, CN, asbestos).

Covering worksuit 1 comprises a first zip closure FG1 in trunk part 2, as well as one or more other closures FG2, FG3 extending in at least one of the legs 31, 32 of trouser part 3, which will be described below and which can be the zip closures described below with a slider, called first type of closure as for closure FG1, or closures of the second type not bearing the slider on covering worksuit 1 and nevertheless with strips that can be separated along their meshing line LE2 or LE3 of meshing, as described below.

Thus, as shown in FIGS. 1 to 10, 15 and 17, first zip closure FG1 is of the first type and extends on the front of wall 4 of trunk part 2 between a first left edge 41 of this wall 4 and a second right edge 42 of this wall 4. First side (or first strip) BA11 of zip closure FG1 is attached in a dustproof manner to left edge 41 of wall 4. Second side (or second strip) BA12 of zip closure FG1 is attached in a dustproof manner to right edge 42 of wall 4 of trunk part 2. The two sides BA11 and BA12 are configured so as to be able to be connected to each other along the first prescribed meshing line LE1, which is dustproof in the closed state of first zip closure FG1. The two sides BA11 and BA12 are also configured to be able to be separated from each other along first meshing line LE1 in the open state of first zip closure FG1. The first zip closure FG1, the two edges 41 and 42, the two sides BA11 and BA12 and the meshing line LE1 extend, for example, from a collar C located at the top of trunk part 2 to at least a crotch area Z of trouser part 3 and can be vertical in the middle of the front part of trunk 2. First zip closure FG1 comprises a slider CU (for example metal or plastic) making it possible to connect first and second sides BA11, BA12 together along first meshing line LE1 by raising (in the closing direction S10 of FIG. 17) slider CU along them and making it possible to separate first and second sides BA11, BA12 from each other along first meshing line LE1 by lowering (in the opening direction S20 of FIG. 17) slider CU along one of the first and second sides BA11, BA12. Slider CU is connected to a manual gripping member OP, for example oblong in shape.

In the following, a zip closure has the meaning known to the person skilled in the art and comprises two parallel strips or first and second sides BA11 and BA12 extending in length and each comprising a series of consecutive teeth respectively D1, D2 and Dr, D2' distributed in the meshing direction LE1, as shown in FIG. 17 for zip closure FG1. Each of teeth D1, D2 of strip BAH collaborates with a space between the teeth of strip BA12 facing it, said collaboration being induced by the movement of slider CU which is moved in the closing direction S10 along strips BA11 and BA12 and which forcibly interweaves teeth D1, D2 of strip BA11 with teeth Dr, D2' of the other strip BA12, which thus causes the two strips BA11 and BA12 to mesh with each other along meshing line LE1, which has the effect of securing the two strips BA11 and BA12 to each other, zip closure FG1 being in the closed state in this case. To open the zip closure FG1, slider CU is moved in the opening direction S20 reverse to the closing direction S10 along strip BA11 or BA12, which has the effect of separating teeth D1, D2 of strip BA11 relative to teeth D1', D2' of the other strip BA12 which are then separated from each other, the zip closure FG1 being in the open state in this case. An opening stop member (separable stop) OA3 located at a lower end BA110 of strip BA11 or at a lower end BA120 of BA12 is provided to stop the course of slider CU in direction S20. Another closing stop member OA1 located at the other end BA111 of strip BA11 and/or another closing stop member OA2 located at the other end BA121 of strip BA12 is provided to stop the course of slider CU in direction S10. The closure strips are, for example, textile braids receiving stitches, for example 5 mm Vislon injected stitches.

The other closure FG2 and/or FG3 extends from top to bottom between two other opposite edges respectively 311, 312 and/or 321, 322 of wall 4 located in at least one of the legs 31, 32 of trouser part 3. Leg 31 is, for example the left leg of trouser part 3, and leg 32 is, for example, the right leg of trouser part 3. The other closure FG2 and/or FG3 starts, for example from crotch area Z of covering worksuit 1. This other closure FG2 and/or FG3 comprises two strips, respectively BA21, BA22 and/or BA31, BA32, which are respectively attached in a dustproof manner to the two opposite edges, respectively 311, 312 and/or 321, 322 of wall 4. The two strips BA21, BA22, respectively BA31, BA32 are configured to be able to be connected together along at least one other prescribed meshing line LE2, respectively LE3, which is dustproof in the closed state of closure FG2, respectively FG3 and are configured to be able to be separated from each other along this other meshing line LE2, respectively LE3, in the open state of closure FG2, respectively FG3.

As shown in FIGS. 1 to 7, at least one connection point S or S1 or S2 or CO connects together at least two of strips BA21, BA22, BA31, BA32 beyond the other meshing line LE2 and/or LE3. This connection point S or S1 or S2 or CO is present between first zip closure FG1 and the other closure FG2 and/or FG3 in the closed state of closures FG1, FG2, FG3. Connection point S or S1 or S2 or CO is present, for example, in crotch area Z. Connection point S or S1 or S2 or CO prevents the untimely opening of zip closure FG2 and/or FG3 when operators are working.

At least one breaking member CU or LA is provided on at least one of closures FG1, FG2 and FG3. This breaking member CU or LA is configured to break connection point S or S1 or S2 or CO when the breaking member CU or LA is pulled.

Thus, the embodiment described above of the covering worksuit 1 allows the person wearing it to open the covering worksuit 1 in a prescribed, intuitive and quick way by pulling the breaking member CU or LA, which breaks the connection point S or S1 or S2 or CO, and makes it possible to change from the closed state to the open state the first zip closure FG1 and the other closure(s) FG2 and/or FG3 by separating them along their prescribed meshing line LE1, LE2 and/or LE3. In this way, it is avoided that the individual contaminates himself by the radioactive particles present on the outside of the covering worksuit 1 when he opens this covering worksuit 1 to remove it.

Breaking member CU or LA is accessible from the outside of the covering worksuit 1 by the individual who wears the covering worksuit 1. In this way, it is avoided that, when the individual pulls on the breaking member CU or LA, contaminated particles enter the covering worksuit 1 when going to the open state of closures FG1, FG2 and/or FG3. In this way, it is avoided that the operator wearing the covering worksuit 1 contaminates himself or other individuals or the areas when he removes this covering worksuit 1 and comfort is also improved during this undressing phase, in particular to avoid off balance positions when crossing the boundary separating contaminated areas and uncontaminated areas, indicated above.

The first closure FG1 and the other closure(s) FG2 and/or FG3 are, for example, arranged in a Y shape, as shown in FIGS. 1, 3 and 5, with connection point(s) S or S1 or S2 or CO located in the center of the Y. This makes it possible to open trunk part 2 along line LE1 then legs 31 and 32 of trouser part 3 along lines LE2 and LE3, so that the individual can be completely free of covering worksuit 1. Covering worksuit 1 is held simply by the top of trunk part 2 on the individual's shoulders, so that no part of covering worksuit 1 comes into contact with the ground.

The covering worksuit 1 makes it possible for the person wearing it to avoid having to tear their covering worksuit at the crotch down to the bottom of the trousers, which could potentially resuspend contaminated particles. On the contrary, covering worksuit 1 is opened along the prescribed meshing lines LE1, LE2 and/or LE3 from top to bottom with no abrupt movements accompanying the opening movement and no risk of introducing the hands behind wall 4, down to the bottom of trouser part 3.

Below, first, second and third embodiments of the covering worksuit 1 described above will be described.

In the first embodiment shown in FIGS. 1 and 2, the first zip closure FG1 extends downward between two opposite edges 311 and 312 of wall 4 in the other 31 of the legs 31, 32 of trouser part 3, while the other closure FG3 described above is present in leg 32 of trouser part 3. First zip closure FG1 extends, for example, to the bottom of leg 31. Closure FG2 extends, for example, from crotch area Z to the bottom of the other leg 32. Of course, this could also be the opposite, i.e., in a variant, first zip closure FG1 extends from top to bottom between two opposite edges 321 and 322 of wall 4 in leg 32 of trouser part 3 and the other closure FG2 is present in leg 31 of trouser part 3. The connection point S initially connects strip BA31 to strip BA32. Connection point S can be located on the first side BA11 of closure FG1 or on the second side BA12 of closure FG1. The breaking member LA is formed by slider CU, whose descent on the connection point S when slider CU descends along the sides BA11 and BA12 to open first meshing line LE1, makes it possible to break the connection point S.

FIG. 2 shows that connection point S is located on the second side BA12 of closure FG1. For example, a transverse notch ENT is provided in the second side BA12 of closure FG1, this notch ENT ending between two successive teeth D1 and D2 of the second side BA12. The connection point S is intended to cover at least or partially the notch ENT to connect together the upper part BA121 of the second side BA12 and the lower part BA122 of the second side BA12, which are separated by the notch ENT. The two strips BA31 and BA32 overlap the second side BA12 at their end. The meshing line LE2 is aligned with the connection point S. The meshing line LE2 is, for example, essentially aligned with the notch ENT. In this case, the end of the strip BA31 overlaps the lower part BA122 of the second side BA12 and the strip BA32 overlaps the upper part BA121 of the second side BA12. These ends of the strips BA31 and BA32 are attached, for example sewn, on the two parts BA122 and BA121, respectively. Underneath the notch ENT, a dustproof component SP can be provided, forming a sub-bridge, which is attached, for example by sewing, under the strip BA11 and extends beyond it under the strip BA12. This component SP thus makes it possible to prevent radioactive particles from penetrating to the inside of the covering worksuit 1 by going through notch ENT. During manufacture, notch ENT of strip BA12 is made, then the two teeth D1 and D2 are welded. In case that the closure FG3 is of the first type bearing its other slider, this system does not permit raising this other slider from the bottom of leg 32 to the collar. The covering worksuit 1 can, for example, be supplied with the slider CU of closure FG1 being positioned above the connection point S and closure FG3 being also closed.

To put on the covering worksuit 1, the individual lowers the slider CU as far as above the connection point S or S1 or S2 to open the first closure FG1 above this point, puts his head through collar C and its trunk through trunk part 2, its arms in the sleeves M and its legs in the parts 31 and 32 of the trouser part 3. Then the individual raises the slider CU along the meshing line LE1 up to the top to close the closure FG1 again.

To open covering worksuit 1, the individual lowers the slider CU of the closure FG1 to pass it on the connection point S, which breaks the connection point S, then continues to lower the slider CU along the leg 31 to the bottom, then the individual opens the closure FG3 along the meshing line LE3 in the leg 32 to the bottom.

In the second embodiment shown in FIGS. 3 and 4 and in the third embodiment shown in FIGS. 5 to 9, both the second closure FG2 having the two second strips BA21 and BA22 extending from top to bottom in wall 4 of leg 31 and the third closure FG3 having the two third strips BA31 and BA32 extending from top to bottom in the wall 4 of leg 32 are provided as other closures.

In the second embodiment shown in FIGS. 3 and 4, the first connection point S1 connects the upper end BA210 of the second strip BA21 to the upper end BA220 of the second strip BA22 beyond the second meshing LE2 between them.

In the second embodiment shown in FIGS. 3 and 4, the second connection point S2 connects the upper end BA310 of the third strip BA31 to the upper end BA320 of the third strip BA32 beyond the second meshing LE3 between them.

The breaking member is formed by or comprises a tab LA having a lower side part LA2 fastened, for example by sewing, to the second strip BA22 and another side part LA3 (at a distance from side part LA2) fastened, for example by sewing, to the third strip BA31, the strips BA22 and BA31 being those of the second strips and of the third strips that are the closest to one another. Tab LA is also located near first and second connection point S1 and S2. Tab LA comprises an upper part LA1 for manual gripping that can be formed, for example, by a closed loop of fabric at parts LA2 and LA3 to allow a finger to pass through it. Tab LA is configured to induce, by pulling on tab LA, the breaking of the first and second connection points S1 and S2, the separation of the two seconds strips BA21 and BA22 from one another along the second meshing line LE2 and the separation of the two third strips BA31 and BA32 from one another along the third meshing line LE3. The gripping part LA1 is provided, for example, underneath the lower ends BA110 and BA120 of the sides BA11 and BA12 of the first closure FG1.

First closure FG1 extends, for example, from top to bottom from collar C to tab LA at crotch area Z. Second closure FG2 extends, for example, from crotch area Z to the bottom of leg 31 of trouser part 3. Third closure FG3 extends, for example, from crotch area Z to the bottom of leg 32 of trouser part 3. To remove the covering worksuit 1, the individual wearing it lowers the slider CU of the first zip closure FG1 down to tab LA in the crotch area Z. The slider CU then reaches the lower ends BA110 and BA120 above the tab LA to separate the two sides BA11 and BA12 including at their lower end BA110 and BA120 by an interval, which releases an access of the user's hand to the tab LA, for example to its gripping part LA1. The individual then pulls the tab LA downward, i.e., for example, the gripping part LA1, which breaks the connection points S1 and S2 and then opens the closure FG2 from top to bottom along the meshing line LE2 from the upper ends BA210 and BA220 and opens the second closure FG3 from top to bottom along the meshing line LE3 from the upper ends BA310 and BA320.

Moreover, the tab LA can comprise an attachment to the wall 4 in the crotch area Z, for example by sewing or gluing. The tab LA can be located higher than the lower ends BA110, BA120 of the zip closure FG1 to constitute a sub-bridge making a barrier to contamination when the operator is working.

The first connection point S1 connects, for example, the upper end tooth D21 of the strip BA21 to the upper end tooth D22 of the strip BA22.

The first connection point S2 connects, for example, the upper end tooth D31 of the strip BA31 to the upper end tooth D32 of the strip BA32.

Due to the fact that, in the closed state of the closures FG1, FG2 and FG3, the tab LA is found inside the covering worksuit 1, the tab LA is not contaminated by radioactives particles. Pulling on the tab LA by the individual who wears the covering worksuit 1 naturally opens the zip closures FG2 and FG3 by simple separation of their respective strips BA21, BA22 and BA31, BA32 along their prescribed meshing line LE2 and LE3.

The individual can then pull on the outer edges 311 and 322 of the legs 31 and 32 to finish opening the closures FG2 and FG3 along the meshing lines LE2 and LE3.

In a third embodiment shown in FIGS. 5 to 9, the connection point is formed by a connection part CO, for example provided on the outer surface of the covering worksuit 1 when the closures FG1, FG2 and FG3 are in the closed state. The connection part CO comprises a first connection flank J1 connecting the lower end BA110 of the first side BA11 to the lower end BA120 of the second side BA12, a second connection flank J2 connecting the upper end BA210 of the second strip BA21 to the upper end BA220 of the second strip BA22 and a third connection flank J3 connecting the upper end BA310 of the third strip BA31 to the upper end BA320 of the third strip BA32. The breaking member LA is formed by the slider CU of the first zip closure FG1. The breaking member LA is configured so that its descent on the connection part CO makes it possible to break the first, second and third connection flanks J1, J2, J3.

The operation is as follows, for example, illustrated in reference to FIGS. 6 to 9.

In a first step in FIG. 6, the closures FG1, FG2 and FG3 are in the closed state and the slider CU is located near the upper end thereof. The operator moves the slider CU in the direction of arrow F1 downward to change the closure FG1 to the open state.

In a second step in FIG. 7, the zip closure FG1 being open and its sides BA11 and BA12 being separated from each other as shown by arrows F1 and F2, the user continues to lower the slider CU against the first connection flank J1 to start to break the connection part CO connecting the three closures FG1, FG2 and FG3. The connection part CO comprises a prescribed weak point, so that the part CO breaks beyond a force threshold. The connection part CO can comprise, as a non-limiting example, an intrinsic connection in the immediate vicinity of the six strips BA11, BA12, BA21, BA22, BA31, BA32 of the three closures FG1, FG2 and FG3. The connection part CO can also be a fabric component, sewed or glued, that can exhibit tear DE as soon as force threshold is exceeded.

In a third step in FIG. 8, the connection part CO is broken into a part CO, which is connected on the one hand to the side BA11 and on the other hand to strip BA21, and into another part CO', which is connected on the one hand to the side BA12 and on the other hand to the strip BA32, and opens from the connection flanks J2 and J3 the closures FG2 and FG3 along their prescribed meshing line LE2, LE3, as shown by arrows F4, F5, F6 and F7, which represent the separation of the two strips BA21, BA22 and BA31, BA32 of each of closures FG2 and FG3.

In a fourth step in FIG. 9, the complete opening of the closures FG1, FG2 and FG3 is accomplished as shown by arrows F8, F9, F10, F11, F12, F13 and the operator can remove the covering worksuit 1.

This embodiment is intrinsically hermetically sealed to contamination, since it does not offer any open area requiring arranging a sub-bridge SP like the first embodiment.

The other closure FG2 and/or FG3 can also be a zip closure of the first type comprising its own slider (called other slider) separate from the slider CU, to allow strip BA21 to be connected together with strip BA22 or strip BA31 to strip BA32 along the other meshing line LE2 or LE3 by moving this other slider from bottom to top along it and to allow strip BA21 to be separated from strip BA22 or strip BA31 to be separated from strip BA32 along this other meshing line LE2 or LE3 by moving this other slider from top to bottom along one of these strips.

However, the two strips BA21 and BA22 can be of the second type not bearing a slider on the covering worksuit 1 as indicated above, to mesh with each other along the other meshing line LE2 in the closed state, these two strips BA21 and BA22 being configured to be able to be separated from each other along the other meshing line LE2 by pulling on one and/or the other of the two strips BA21 and BA22, i.e., without having a slider for them to be separated. The two strips BA31 and BA32 of the other closure FG3 can be of the second type not bearing a slider on the covering worksuit 1 as indicated above, to mesh with each other along the other meshing line LE3 in the closed state, these two strips BA31 and BA32 being configured to be able to be separated from each other along the other meshing line LE3 by pulling on one and/or the other of the two strips BA31 and BA32, i.e., without having a slider for them to be separated. The closure FG2 and/or FG3 of the second type can have been obtained by sectioning a desired length L of a slider zip closure in the closed state, this length L being located behind the slider (for example of plastic) of this zip closure in the closed state in the closing direction S10, as shown in FIG. 17. This length L has the strips BA21 and BA22 or BA31 and BA32 connected to each other by meshing of their teeth along their meshing line LE1 or LE2 and does not bear the slider of this zip closure in the closed state. This length L is kept to make the closure FG2 and/or FG3.

According to an embodiment shown in FIG. 10, the trunk part 2 ends at the top in a closed collar C, located beyond the upper end FG10 of first zip closure FG1. The collar C is dustproof and comprises a left front part C1 and a right front part C2, which is connected to the left front part C1 by a front closure strip CF. This front closure strip CF is dustproof and located higher than the upper end FG10 of the first zip closure FG1. This front closure strip CF makes it possible to prevent contaminated particles from crossing collar C and reaching the neck of the individual above closure FG1. Thus zip closure FG1 does not close at the top of collar C but up to the limit of the bottom of collar C. This allows the zip closure FG1 to be easily opened without holding the collar. The collar C is thus of crossover type with the front closure strip CF forming a valve to protect the neck from external contamination and to cover the underlying clothing.

Two front and side tags PF1 and PF2, respectively left and right, can be attached in front of the front closure strip CF. The tags PF1 and PF2 serve for manual gripping of collar C without inserting the fingers inside the collar C, which prevents contaminated particles from being introduced therein.

According to an embodiment shown in FIG. 10, the gripping member OP of the slider CU of the first zip closure FG1 can be extended by a fabric part, for example of a different color from that of the other parts of the zip closure FG1 and the wall 4. Operators can thus more easily identify and seize the slider CU and avoid searching for it and thus avoid to increase the risk of clothing and/or bodily contamination. This extender PT of slider CU must not be too short, since it must be able to be seized by a hand covered with a cotton glove, nor too long, in order to avoid being caught while working.

According to an embodiment show in in FIG. 11, the covering worksuit 1 comprises lines LC1, LC2, LC3 of stitching visible on the wrong side ENV of the wall 4 and invisible on the right side END of the wall 4. These lines of stitching LC1, LC2, LC3 are, for example, of a different color from that of the wall 4 or that of the wrong side ENV of the wall 4. The individual can thus better distinguish the wrong side ENV and the right side END of the covering worksuit 1. Indeed, the covering worksuit 1 is used only once. When undressing, once the covering worksuit 1 is removed, the operator discards it in a dedicated waste bin. During this phase, the operator must not contaminate his hands, particularly when he folds the covering worksuit 1. Indeed, since the wrong side ENV and the right side END of the covering worksuit 1 are most often white in color, the operator can mix up the wrong side ENV free of contamination with the right side END which can be contaminated. These stitching lines guide the operator so as not to contaminate himself.

In an embodiment shown in FIG. 12, the covering worksuit 1 comprises two sleeves M for passing the individual's arms. Each sleeve M comprises a second dustproof wall 46 and is connected at the top of the trunk part 2. Each sleeve comprises a free end edge BE, which surrounds the end opening OUV making it possible to pass at least the index, middle, ring and little fingers of the individual's hand. Each sleeve M comprises at least one hole TPP for passage of the thumb of the individual's hand. This thumb hole TPP is distinct from the opening OUV and is separated from the end edge BE by an end part 47 of the second wall 46. The operators can wear cotton gloves, sometimes covered with vinyl or other gloves depending on the type of procedure. Then they put on the covering worksuit 1. Note that under certain working conditions, operators have a tendency to use adhesive tape to connect the covering worksuit of the state of the art to the gloves, so that no part of the arm is found uncovered, which would not be acceptable vis-à-vis the risk of contamination. However, the use of adhesive tape becomes prohibited for some plants. The embodiment described above having the thumb hole TPP integrated into the covering worksuit 1 remedies this issue. This thumb hole TPP can have the form of a vent at the end of the sleeve M. This thumb hole TPP can be indicated on its outline by a different color from the rest of the second wall 46 of the sleeve M, which indicates its position. The positioning of this thumb hole towards the top of the free end edge BE of the sleeve M allows intuitive dressing to pass the thumb therein without hindering the movement of the operator's arms for all work situations. This thumb hole is also called thumb loop.

According to an embodiment shown in FIG. 13, the waist T of the covering worksuit 1 comprises a peripheral inner sheath FT in which is positioned an elastic EL for peripheral tightening. In the state of the art, operators habitually choose a size for the covering worksuit 1 greater than their own size, in order to be able to have more room, ease and comfort inside the covering worksuit, especially during sustained physical effort. However, in this case, there is a puffy effect which comes mainly from an elastic sewn into the covering worksuit all around the waist. This puffy effect is conducive to snagging or tearing the covering worksuit, which can then contaminate the operator. This embodiment resolves this problem by making it possible to insert the more flexible elastic EL in the back of the covering worksuit 1 in the sheath FT, this elastic EL not being sown into the covering worksuit 1 in order not to have the puffy effect.

According to an embodiment of the invention shown in FIG. 14, the covering worksuit 1 bears reinforcements RG at the knees G of the trouser part 3. This prevents tearing of the covering worksuit 1 and thus prevents contaminations. These reinforcements RG have, for example, a height and width greater than that of the individual's knees, to be able to suit all body shapes.

According to an embodiment shown in FIG. 15, the covering worksuit 1 comprises a transparent outer wall 43 located to the left of the first zip closure FG1 on the front in trunk part 2 and/or a transparent outer wall located to the right of the first zip closure FG1 on the front in trunk part 2. This wall 43 and/or 44 forms an outer transparent window. This wall 43 and/or 44 located on the right side END of the covering worksuit 1 respectively forms a left pocket PCH1 and/or a right pocket PCH2 with, respectively, another underlying left wall 43*b*, located on the wrong side ENV and/or with another underlying right wall 44*b*, located on the wrong side ENV. The wall 43*b* and/or 44*b* can be transparent or opaque. The left pocket PCH1 and/or the right pocket PCH2 has a width greater than or equal to 15 cm and a height greater than or equal to 15 cm. The transparent outer wall 43 and/or 44 allows the individual to see the objects located in the pocket PCH1 and/or PCH2 from the outside and thus to be able to see in real time the numerical value of the dose displayed by a dosimeter present in this pocket. It is imperative for the operator to have continuous access to read the dosimetry on their own dosimeter, so that it does not exceed the predicted dose and, in some cases, the regulatory limits. This prevents the operator from having to open the covering worksuit 1 in order to read this dosimetry and thus prevents that the operator contaminates himself. The wall 43 and/or 44 forms a transparent window at the chest. This wall 43 and/or 44 and/or 43*b* and/or 44*b* may be of an acetate type material, or the like, which has the property of remaining transparent when it is folded. The dimension of the window has been designed so that the dosimeter pouch PCH4 is always visible even in cases where it moves during physical exertion, this dosimeter pouch PCH4 itself being formed of transparent walls and having been inserted into pocket PCH1 or PCH2. The pockets PCH1 and/or PCH2 can be of the wallet window type. As a variant, the other wall 43*b* and/or 44*b* can be made of the same material as the wall 4, not transparent. The pocket PCH1 and/or PCH2 has an opening located in its upper part between its wall 43 and/or 44 and its wall 43*b* and/or 44*b*. The underlying wall 43*b* and/or 44*b* is made of a dustproof material. Regulations require that the dosimeters be positioned on the chest. Note that, in the state of the art, it is often tedious to adjust the fasteners of the dosimeter pouch to position it on the chest and it changes position during exertion. The proposed solution resolves this problem and meets regulatory requirements.

According to an embodiment shown in FIG. 16, the covering worksuit 1 comprises a removable pouch PCH5 on the stomach with a transparent outer wall 45, This pouch PCH5 is located on the chest and can contain type A4 documents and/or small equipment. The wall 45 can be of acetate, for example. The underlying wall of the pouch PCH5 can also be of a transparent or non-transparent material. The pouch PCH5 has an upper part comprising a fourth zip closure FG4 and fasteners AT configured to be able to be connected and disconnected relative to a corresponding front upper part of the trunk part 2. These fasteners AT are, for example, clip type. The pouch PCH5 can also comprise fasteners in its lower part, these fasteners can be snap buttons, for example. The choice of fastener of different types between the upper part and the lower part of the pouch PCH5 makes it possible to provide a mistake-proofing for the operator and to guide the operator to put the pouch PCH5 on in the right direction. This pouch PCH5 enables the operator to read a document or keep a small equipment (for example a phone or the like) without contaminating it.

Of course, the embodiments, features, possibilities and examples above can be combined with one another or selected independently from one another.

The invention claimed is:

1. A covering worksuit being disposable and individual for protection against radioactive particles, comprising a trunk part and a trouser part, which is of one piece with the trunk part and which extends down from the trunk part, the trunk part and the trouser part having a wall, which is flexible and dustproof, the covering worksuit comprising a first zip closure, which extends from top to bottom and on a front between a left edge and a right edge of the wall at least in the trunk part, the first zip closure having a first side attached in a dustproof manner to the left edge of the wall and a second side attached in a dustproof manner to the right edge of the wall, the first side and the second side configured to be connected together according to a first meshing line dustproof in a closed state of the first zip closure and configured to be separated from each other along the first meshing line in an open state of the first zip closure, wherein the covering worksuit comprises at least one other closure, which extends from top to bottom between two other opposite edges of the wall in at least one of the legs of the trouser part and which comprises two strips respectively attached in a dustproof manner to the two other opposite edges of the wall, the two strips configured to be connected to each other according to at least one other meshing line dustproof in a closed state of the at least one other closure and being able to be separated from each other along the at least one other meshing line in an open state of the at least one other closure, at least one connection point connecting together the two strips beyond the at least one other meshing line present between the first zip closure and the at least one other closure in the closed state, at least one breaking member provided on at least one of the first zip closure, of the at least one other closure to be able to break the at least one connection point by pulling on the at least one breaking member, the first zip closure further extending from top to bottom between the two opposite edges of the wall in the other of the legs of the trouser part, the at least one connection point located on the first side or on the second side of the first zip closure, the first zip closure comprising a slider configured to connect the first side and the second side together along the first meshing line by raising the slider along them and to separate the first side and the second side from each other along the first meshing line by lowering the slider along the first side and the second side, the at least one breaking member being formed by the slider, which is configured to break the at least one connection point by lowering the slider along the at least one connection point and along the first side and the second side.

2. The covering worksuit according to claim 1, wherein the at least one other closure is another zip closure, comprising another slider configured to connect the two strips together along the at least one other meshing line by movement of the other slider from bottom to top along the two strips and configured to separate the two strips from each other along the at least one other meshing line by movement of the other slider from top to bottom along the strips.

3. The covering worksuit according to claim 1, wherein the two strips of the at least one other closure mesh with each other along the at least one other meshing line in the closed state of the at least one other closure, the two strips of the at least one other closure being configured to be separated from each other along the at least one other meshing line by pulling on one and/or the other of the two strips.

4. The covering worksuit according to claim 1, wherein the at least one connection point is located in a crotch area of the trouser part or in a lower abdomen area of the trouser part.

5. The covering worksuit according to claim 1, wherein the trunk part ends at a top end with a dustproof collar, having a left front part and a right front part connected together by a dustproof front closure strip located beyond an upper end of the first zip closure.

6. The covering worksuit according to claim 5, wherein a free front and side tag and a second free front and side tag are attached in front of the front closure strip.

7. The covering worksuit according to claim 1, wherein the covering worksuit comprises stitching lines visible on a wrong side of the covering worksuit and invisible on a right side of the covering worksuit.

8. The covering worksuit according to claim 1, wherein the covering worksuit comprises sleeves configured for passing the arms therethrough, wherein the sleeves comprise a second wall being dustproof, are connected at a top of the trunk part, a free end edge of the sleeves surrounds an end opening configured for passing at least the index finger, middle finger, ring finger and little finger of the hand therethrough, the sleeves further comprise at least one hole configured for passing the thumb therethrough, distinct from the end opening and separated from the free end edge by an end part of the second wall.

9. The covering worksuit according to claim 1, wherein the covering worksuit comprises a tightening elastic situated in a sheath in a waist of the covering worksuit.

10. The covering worksuit according to claim 1, wherein the covering worksuit comprises reinforcements at knees of the trouser part.

11. The covering worksuit according to claim 1, wherein the covering worksuit comprises at least one transparent outer wall, which is located to the right and/or the left of the first zip closure on the front in the trunk part and which forms at least one pocket with at least one other underlying wall.

12. The covering worksuit according to claim 1, wherein the covering worksuit comprises a removable stomach pouch having a transparent outer wall, the removable stomach pouch having an upper part comprising a fourth zip closure and fasteners configured to be connected and disconnected relative to a front upper part of the trunk part.

13. A covering worksuit being disposable and individual for protection against radioactive particles, comprising a trunk part and a trouser part, which is of one piece with the trunk part and which extends down from the trunk part, the trunk part and the trouser part having a wall, which is flexible and dustproof, the covering worksuit comprising a first zip closure, which extends from top to bottom and on a front between a left edge and a right edge of the wall at least in the trunk part, the first zip closure having a first side attached in a dustproof manner to the left edge of the wall and a second side attached in a dustproof manner to the right edge of the wall, the first side and the second side configured to be connected together according to a first meshing line dustproof in a closed state of the first zip closure and configured to be separated from each other along the first meshing line in an open state of the first zip closure, the covering worksuit comprising:

at least one second closure, which extends from top to bottom between two second opposite edges of the wall in one of the legs of the trouser part and which comprises two second strips respectively attached in a dustproof manner to the two second opposite edges of the wall, the two second strips being able to be connected to each other according to a second meshing line, dustproof in a closed state of the second closure, and configured to be separated from one another along the second meshing line in an open state of the second closure, and at least one third closure, which extends from top to bottom between two third opposite edges of the wall in the other of the legs of the trouser part and which comprises two third strips respectively attached in a dustproof manner to the two third opposite edges of the wall, the two third strips configured to be connected to each other according to a third meshing line, dustproof in a closed state of the third closure, and configured to be separated from one another along the third meshing line in an open state of the third closure, and a first connection point that connects together upper ends of the two second strips of the second closure beyond the second meshing line and is present between the first zip closure and the at least one second closure in the closed state of them, and a second connection point that connects together upper ends of the two third strips of the third closure beyond the third meshing line and is present between the first zip closure and the at least one third closure in the closed state of them, and at least one breaking member comprising a tab attached to one of the second strips and to one of the third strips close to each other and close to the first connection point and to the second connection point, to allow breaking the first connection point and the second connection point by pulling on the tab, separating the two second strips from each other along the second meshing line and separating the two third strips from each other along the third meshing line.

14. The covering worksuit according to claim 13, wherein the at least one second closure is a second zip closure, comprising a second slider configured to connect the two second strips together along the second meshing line by movement of the second slider from bottom to top along the two second strips and configured to separate the two second strips from each other along the second meshing line by movement of the second slider from top to bottom along the second strips, the at least one third closure is a third zip closure, comprising a third slider configured to connect the two third strips together along the third meshing line by movement of the third slider from bottom to top along the two third strips and configured to separate the two third strips from each other along the third meshing line by movement of the third slider from top to bottom along the third strips.

15. The covering worksuit according to claim 13, wherein the two second strips of the at least one second closure mesh with each other along the second meshing line in the closed state of the at least one second closure, the two second strips of the at least one second closure configured to be separated from each other along the second meshing line by pulling on one and/or the other of the two second strips, the two third strips of the at least one third closure mesh with each other along the third meshing line in the closed state of the at least one third closure, the two third strips of the at least one third closure configured to be separated from each other along the third meshing line by pulling on one and/or the other of the two third strips.

16. The covering worksuit according to claim 13, wherein the first connection point is located in a crotch area of the trouser part or in a lower abdomen area of the trouser part, the second connection point is located in the crotch area of the trouser part or in the lower abdomen area of the trouser part.

17. The covering worksuit according to claim 13, wherein the trunk part ends at a top end with a dustproof collar, having a left front part and a right front part connected together by a dustproof front closure strip located beyond an upper end of the first zip closure.

18. The covering worksuit according to claim 17, wherein a first free front and side tags and a second free front and side tag are attached in front of the front closure strip.

19. The covering worksuit according to claim 13, wherein the covering worksuit comprises stitching lines visible on a wrong side of the covering worksuit and invisible on a right side of the covering worksuit.

20. The covering worksuit according to claim 13, wherein the covering worksuit comprises sleeves configured for passing the arms therethrough, wherein the sleeves comprise a second wall being dustproof, are connected at a top of the trunk part, a free end edge of the sleeves surrounds an end opening configured for passing of at least the index finger, middle finger, ring finger and little finger of the hand therethrough, the sleeves further comprise at least one hole configured for passing the thumb therethrough, distinct from the end opening and separated from the free end edge by an end part of the second wall.

21. The covering worksuit according to claim 13, wherein the covering worksuit comprises a tightening elastic situated in a sheath in a waist of the covering worksuit.

22. The covering worksuit according to claim 13, wherein the covering worksuit comprises reinforcements at knees of the trouser part.

23. The covering worksuit according to claim 13, wherein the covering worksuit comprises at least one transparent outer wall, which is located to the right and/or the left of the first zip closure on the front in the trunk part and which forms at least one pocket with at least one other underlying wall.

24. The covering worksuit according to claim 13, wherein the covering worksuit comprises a removable stomach pouch having a transparent outer wall, the removable stomach pouch having an upper part comprising a fourth zip closure and fasteners configured to be connected and disconnected relative to a front upper part of the trunk part.

25. A covering worksuit being disposable and individual for protection against radioactive particles, comprising a trunk part and a trouser part, which is of one piece with the trunk part and which extends down from the trunk part;

the trunk part and the trouser part having a wall, which is flexible and dustproof;

the covering worksuit comprising a first zip closure, which extends from top to bottom and on a front between a left edge and a right edges of the wall at least in the trunk part, the first zip closure having a first side attached in a dustproof manner to the left edge of the wall and a second side attached in a dustproof manner to the right edge of the wall, the first side and the second side configured to be connected together according to a first meshing line dustproof in a closed state of the first zip closure and configured to be separated from each other along the first meshing line in an open state of the first zip closure;

the covering worksuit comprising:

at least one second closure, which extends from top to bottom between two second opposite edges of the wall in one of the legs of the trouser part and which comprises two second strips respectively attached in a dustproof manner to the two second opposite edges of the wall, the two second strips configured to be connected to each other according to a second meshing line, dustproof in a closed state of the second closure, and configured to be separated from one another along the second meshing line in an open state of the second closure; and at least one third closure, which extends from top to bottom between two third opposite edges of the wall in the other of the legs of the trouser part and which comprises two third strips respectively attached in a dustproof manner to the two third opposite edges of the wall, the two third strips configured to be connected to each other according to a third meshing line, dustproof in a closed state of the third closure, and configured to be separated from one another along the third meshing line in an open state of the third closure;

a connection part, which, in the closed state, comprises:

a first connection flank, which connects together lower ends of the first side and of the second side of the first zip closure, beyond the first meshing line and which is present in the closed state between the first zip closure on the one hand and the at least one second closure and the at least one third closure on the other hand;

a second connection flank, which connects together upper ends of the two second strips of the at least one second closure beyond the second meshing line and which is present in the closed state between the first zip closure and the at least one second closure;

and a third connection flank connecting together upper ends of the two third strips of the at least one third closure beyond the third meshing line and which is present in the closed state between the first zip and the at least one third closure;

the first zip closure comprising a slider configured to connect the first side and the second side together along the first meshing line by raising the slider along them and to separate the first side and the second side from each other along the first meshing line by lowering the slider along the first side and the second side;

a breaking member being formed by the slider, which is configured to break the first connection flank, the second connection flank and the third connection flank by lowering the slider along the connection part.

26. The covering worksuit according to claim 25, wherein the at least one second closure is a second zip closure, comprising a second slider configured to connect the two second strips together along the second meshing line by movement of the second slider from bottom to top along the two second strips and configured to separate the two second strips from each other along the second meshing line by movement of the second slider from top to bottom along the second strips, the at least one third closure is a third zip closure, comprising a third slider configured to connect the two third strips together along the third meshing line by movement of the third slider from bottom to top along the two third strips and configured to separate the two third strips from each other along the third meshing line by movement of the third slider from top to bottom along the third strips.

27. The covering worksuit according to claim 25, wherein the two second strips of the at least one second closure mesh with each other along the second meshing line in the closed state of the at least one second closure, the two second strips of the at least one second closure configured to be separated from each other along the second meshing line by pulling on one and/or the other of the two second strips, the two third strips of the at least one third closure mesh with each other along the third meshing line in the closed state of the at least one third closure, the two third strips of the at least one third closure configured to be separated from each other along the third meshing line by pulling on one and/or the other of the two third strips.

28. The covering worksuit according to claim 25, wherein the connection part is located in a crotch area of the trouser part or in a lower abdomen area of the trouser part.

29. The covering worksuit according to claim 25, wherein the trunk part ends at a top end with a dustproof collar, having a left front part and a right front part connected together by a dustproof front closure strip located beyond an upper end of the first zip closure.

30. The covering worksuit according to claim 29, wherein a first free front and side tags and a second free front and side tag are attached in front of the front closure strip.

31. The covering worksuit according to claim 25, wherein the covering worksuit comprises stitching lines visible on a wrong side of the covering worksuit and invisible on a right side of the covering worksuit.

32. The covering worksuit according to claim 25, wherein the covering worksuit comprises sleeves configured for passing the arms therethrough, wherein the sleeves comprise a second wall being dustproof, are connected at a top of the trunk part, a free end edge of the sleeves surrounds an end opening configured for passing at least the index finger, middle finger, ring finger and little finger of the hand therethrough, the sleeves further comprise at least one hole configured for passing the thumb therethrough, distinct from the end opening and separated from the free end edge by an end part of the second wall.

33. The covering worksuit according to claim 25, wherein the covering worksuit comprises a tightening elastic situated in a sheath in a waist of the covering worksuit.

34. The covering worksuit according to claim 25, wherein the covering worksuit comprises reinforcements at knees of the trouser part.

35. The covering worksuit according to claim 25, wherein the covering worksuit comprises at least one transparent outer wall, which is located to the right and/or the left of the first zip closure on the front in the trunk part and which forms at least one pocket with at least one other underlying wall.

36. The covering worksuit according to claim 25, wherein the covering worksuit comprises a removable stomach pouch having a transparent outer wall, the removable stomach pouch having an upper part comprising a fourth zip closure and fasteners configured to be connected and disconnected relative to a front upper part of the trunk part.

* * * * *